US005375780A

United States Patent [19]

Gray et al.

[11] Patent Number: 5,375,780

[45] Date of Patent: Dec. 27, 1994

[54] COMMINUTING WOOD PULP SHEETING

[75] Inventors: Gary E. G. Gray, Westwood Heath; Iain R. Jack, Nuneaton, both of United Kingdom

[73] Assignee: Courtaulds Fibres (Holdings) Ltd., London, England

[21] Appl. No.: 66,544

[22] Filed: May 24, 1993

[51] Int. Cl.[5] ..... B27K 5/00; B02C 7/04

[52] U.S. Cl. ..... 241/28; 241/29

[58] Field of Search ..... 241/3, 19, 28, 29, 60, 241/79.1, 152.2, 236

[56] References Cited

U.S. PATENT DOCUMENTS

| | | | |
|---|---|---|---|
| 3,061,206 | 10/1962 | Matter | 241/60 |
| 3,824,652 | 7/1974 | Buell | 241/28 |
| 4,241,881 | 12/1980 | Laumer | 241/28 |
| 4,252,279 | 2/1981 | Johansson | 241/28 |
| 4,717,085 | 1/1988 | Crane | 241/236 |
| 5,005,770 | 4/1991 | Suessegger | 241/152.2 |
| 5,110,060 | 5/1992 | Lundquist | 241/236 |
| 5,141,168 | 8/1992 | Pepper | 241/236 |

*Primary Examiner*—Timothy V. Eley

*Attorney, Agent, or Firm*—Davis Hoxie Faithful & Hapgood

[57] ABSTRACT

A method of creating a comminuted feedstock of wood pulp for use in a processing plant which includes the steps of mounting a plurality of rolls of wood pulp sheet material of a first range of properties in a first roll stand, drawing sheet material off each roll in the first roll stand and laying the sheet materials one on the other to create a first pluri-layer web, withdrawing the first pluri-layer web from the first roll stand and leading it to a cutting area of a shredding mill, acting on the first pluri-layer web in the cutting area with rotating hooked disc cutters to tear platelets from the first pluri-layer web and to pass the torn platelets to an outlet of the shredding mill, pneumatically conveying the torn platelets away from the outlet using a fan with a bladed member rotating in a fan casing, and beating the torn platelets with the bladed member as they are conveyed through the fan casing to separate the torn platelets into pieces torn from the individual layers making up the first pluri-layer web.

11 Claims, 3 Drawing Sheets

COMMINUTING WOOD PULP SHEETING

BACKGROUND OF THE INVENTION

1. Field of the invention

This invention relates to a method of creating a comminuted feedstock for use in a processing plant and has particular, but not exclusive, reference to cellulose-based feedstock materials which may be used, inter alia, in the production of cellulosic fibres.

It is known to use wood fibres as a feedstock for a variety of different industrial processing plants. The wood fibres can be supplied to users in the form of rolls of wood pulp sheet material which may have to be broken down into small pieces as an initial stage in the process. This invention is concerned with the method of carrying out a breaking down of wood fibre sheet material to produce small pieces for subsequent processing.

Wood pulp is commonly supplied to end users in roll form, each roll being categorised with reference to at least one particular property of the sheet material, the end user selecting which roll to use for the creation of a feedstock on the basis of an assessment of the value of the particular properties assigned to the rolls that are currently available for use as feedstock. The invention has particular, but not exclusive, application to the situation where an eventual feedstock required for subsequent processing is created by mixing together small pieces removed from the sheet material drawn from a number of different rolls.

SUMMARY OF THE INVENTION

According to one aspect of the invention a method of creating a comminuted wood fibre feedstock from at least one sheet of wood pulp includes feeding the at least one sheet into a cutting area defined by a nip created between first and second rows of contra-rotating disc cutters, at least one row being provided with hooks to drag material between the rows of cutters through the nip and thereby to tear pieces out of the sheet.

Suitably the disc cutters in each row are alternated with spacers, the disc cutters and spacers in the first row interdigitating with the spacers and disc cutters in the second row.

Conveniently, each disc cutter has a plurality of hooks. Suitably there are more than four hooks on each cutting disc, preferably between five and ten hooks and more preferably seven hooks. Each spacer can be of comparable thickness to the disc cutters used and a thickness between 20 and 40 mm, preferably around 30 mm, is very suitable.

Each row of cutters and spacers is desirably supported on a shaft extending across the entire length of the cutting area. The shafts can be driven at the same speed suitably from a pair of electric motors.

Static combs can be provided with tines that locate between the disc cutters and spacers in each row, the individual tines of each comb being disposed below the respective shafts and projecting from an edge of an outlet opening of the cutting area towards the centre thereof. The combs ensure that the only exit from a hopper feeding the cutting area is between the two rows of disc cutters, they prevent torn material leaving the cutting area being drawn back up into the hopper, and stop material going through the shredder twice.

Preferably, following comminuting by two rows of interdigitating disc cutters and disc spacers, the torn pieces are fed into a fan which transports them pneumatically downstream to a further processing stage and mechanically agitates the torn pieces to ensure they are separated in preparation for subsequent treatment (e.g. with liquid).

Suitably the wood pulp is fed into the cutting area as a pluri-layer web comprising "n" sheets of wood pulp laid one on the other. More suitably the wood pulp is fed to the cutting area as two or more different pluri-layer webs of wood pulp sheeting.

Each layer in a pluri-layer web of "n" different layers of sheet material may be selected with regard to some known parameter property of the wood pulp whereby the pluri-layer web has an aggregate value of the selected parameter property which lies within a chosen range of values of said parameter property. Conveniently where the feedstock is created by comminuting two or more different pluri-layer webs to create a mass of comminuted pieces of sheet material, there are different numbers of layers in each web.

A pluri-layer web of "n" layers of sheet material laid one on the other can be created in apparatus having a roll stand supporting a plurality of different stock rolls of wood pulp sheet material in side-by-side relationship, with means for drawing sheet material from each of said stock rolls to form a pluri-layer web with "n" layers of sheet material disposed one on another, and with means defining an output of the apparatus through which said pluri-layer web can be forwarded to the cutting area.

Typically "n" is between 4 and 12.

In the production of cellulosic fibres it is known to use as raw material broken pieces of wood pulp sheet material. The subsequent processing can be critically dependent on the aggregate properties of the mass of broken pieces. This invention, in its different aspects, relates to a novel way of producing a mass of broken pieces of wood pulp sheeting of the required aggregate properties.

In the case of stock rolls of sheet-formed wood pulp, suppliers grade the sheet-formed material on a roll, inter alia, on the basis of the viscosity of a liquid product produced in a pre-determined manner from the wood pulp and supply the roll to the end user with a viscosity rating. The end user can then select, from the range of stock rolls available, those having viscosity ratings which he wishes to use for a particular feedstock material.

In accordance with a further aspect of this invention, prior to creating a comminuted feedstock material from a plurality of different stock rolls of wood pulp sheet material of selected viscosity rating, the sheet materials from a number of stock rolls are drawn together to create a pluri-layer web which is fed as such to a pulp mill where the web is torn between contra-rotating disc cutters to create the required feedstock material at the output of the mill.

By the simple expedient of tearing laminated platelets out of a pluri-layer web between contra-rotating disc cutters and subsequently separating the platelets into individual pieces, we have found it possible to simplify the manufacture of feedstock and to exercise greater control over the production of the required feedstock material.

In a preferred arrangement, two or more separate pluri-layer webs are created utilising a separate roll stand for each web, the feedstock material being created by feeding to the pulp mill a pre-selected ratio of web material taken from one stand to web material taken from another stand.

Desirably a first roll stand carries only stock rolls having a viscosity rating in a lower value (hereafter referred to as "LV") band and a second roll stand contains only stock rolls having viscosities in a higher value (hereafter referred to as "HV") band, the comminuted feedstock being created by breaking up, in the cutting area, pluri-layer webs taken from both roll stands.

If the comminuted feedstock is to be used in the creation of cellulosic fibres we have found it to be important to control not only the aggregate value of the viscosity rating of an LV web fed to the cutting area but also the viscosity rating of a HV web fed to the cutting area and to control the proportion of the LV to HV webs in the final comminuted feedstock material produced.

Where just two roll stands are used it is convenient to have different numbers of stock rolls in each stand. One convenient arrangement is for there to be $^{2p}/3$ layers of sheet material in the web leaving an LV roll stand and $^{p}/3$ layers of sheet material in the web leaving a HV roll stand, p being an integer number which is a multiple of 3 and which is not less than 6. p equal to 12 has been found to be a particularly convenient arrangement.

In the or each roll stand, the sheet material from each stock roll can be fed into an unwinding station comprising a pair of rollers each contacted only over part of its circumference by the unwinding sheet material, the downstream roller of each pair defining an advance path for the composite web created in that roll stand. One of the rollers in each pair can be linked to a motion sensing means to detect when the sheet material in that unwinding station is no longer advancing e.g. due to breakage of the sheet material or expiry of the material on that stock roll.

Conveniently the advance path of the pluri-layer web created in the or each stand is disposed below all the stock rolls in that stand. The outlet of the or each roll stand can be provided by a pair of rollers defining a nip, one or both of said nip-defining rollers being driven to advance the web and thereby to draw sheet material off each of the stock rolls providing input for the web, through the outlet nip and into the cutting area where the rotating discs can simultaneously tear all layers together into a mass of separated torn pieces.

A suitable size for the torn pieces would be between 3 and 30 $cm^2$ if the subsequent processing involves the creation therefrom of a viscous dope for subsequent spinning in a fibre bath. Pieces of a size of between 2 and 20 $cm^2$, particularly around 5 to 15 $cm^2$, are preferred.

By tearing or shredding the multi-layer web of pulp sheetings between relatively slowly rotating disc cutters equipped with tearing teeth it is possible to create the separate multi-layer platelets without significant edge compression appearing thereon or on the pieces separated subsequently. Edge compression produces a localised increase in density which in turn affects the reaction rate of a subsequent processing stage in which the comminuted pieces are treated with liquid.

Any tendency for the laminated platelets torn from a pluri-ply web to remain pinched together in pluri-layer form can be overcome by agitating the torn platelets downstream of the pulp mill and we have found that a particularly convenient method of achieving this agitation is to arrange for the torn platelets to be pneumatically conveyed by a rotary fan through which the torn platelets pass and by the rotor of which fan the torn platelets are contacted. A centrifugal fan rotating at some 1800 rpm can be used with great effect to achieve separation of the pieces torn from a laminated platelet. The edges of the blades of the rotor contacted by the stream of dry pulp pieces passing through the casing of the fan can be reinforced to reduce wear thereon.

BRIEF DESCRIPTION OF THE DRAWINGS

One embodiment of apparatus for carrying out a method in accordance with this invention will now be described, by way of example, with reference to the accompanying drawings, in which.

DESCRIPTION OF THE PREFERRED EMBODIMENT

Figure 1:
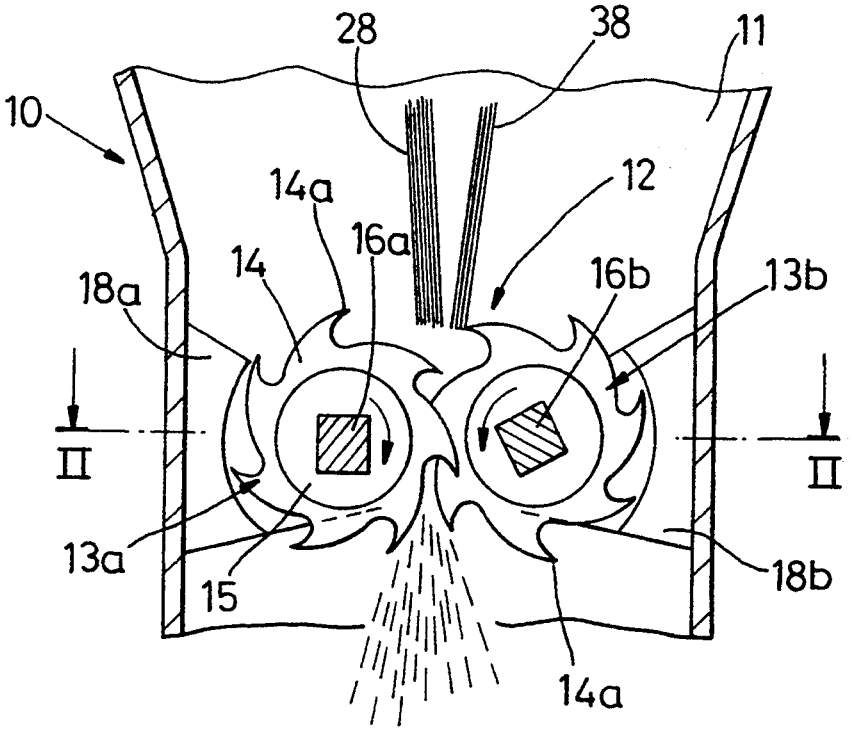
FIG. 1 is a schematic sectional side elevational view of the cutting area of a pulp shredder designed to operate in accordance with the invention.
Figure 2:
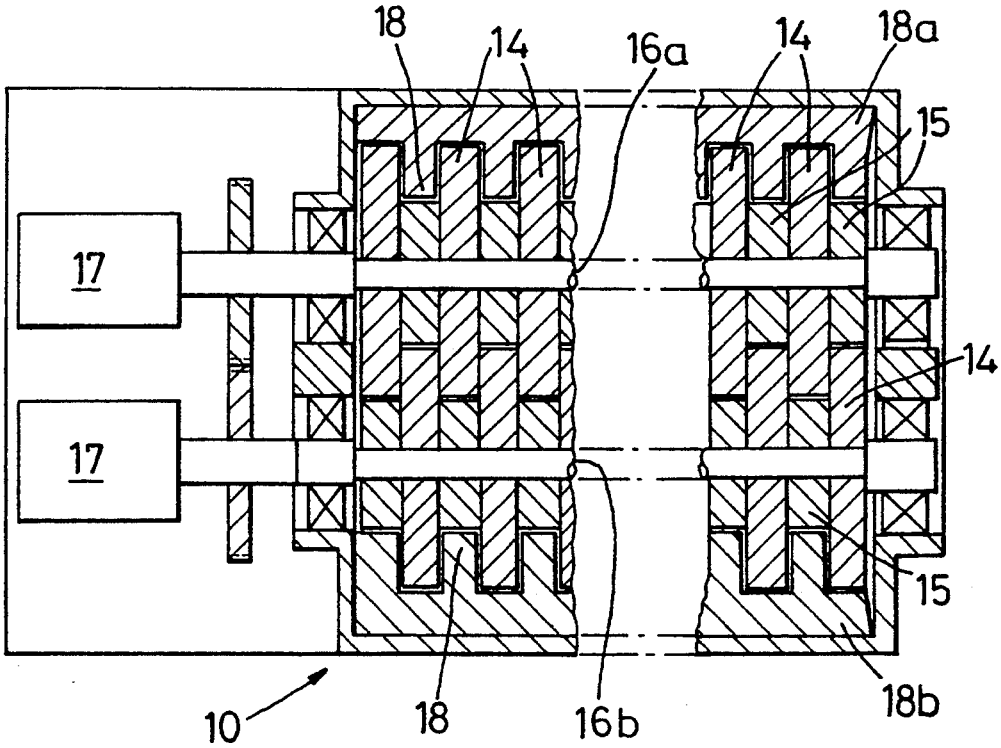
FIG. 2 is a section on the line II—II of FIG. 1 through the cutting area of the shredder shown in FIG. 1.

FIGS. 1 and 2 show a suitable pulp mill 10 for producing torn pieces from a web of wood pulp sheeting fed into the mill.

A hopper 11 receives the sheeting from above at a preset advance speed and conveys it into a cutting area 12 defined by two rows 13*a*, 13*b* of interdigitated disc cutters 14 and disc spacers 15 defining a nip. The cutters 14 and spacers 15 in each row are fixedly supported on a respective rotatable shaft 16*a*, 16*b*, each shaft being driven by a separate electric motor 17. The two motors drive the shafts in opposite directions (see FIG. 1) so that hooks 14*a* on the cutters tear pieces from the web advancing through the hopper 11, passing the torn pieces downwards through the nip into an outlet of the mill 10.

As shown, each disc cutter has seven teeth 14*a* but other arrangements of teeth are possible.

The width of each disc cutter 14 (i.e. the dimension in the axial direction of the shaft) and the speed of advance of the web of sheet material into the cutting area determine the size of the platelets torn from the web and the arrangement shown has cutters and spacers each of a width of 31 mm, this producing platelets with one dimension which is about 30 mm. The other dimension depends on the web advance speed but in a typical case pieces (see FIG. 6) 40 of a size around 10 $cm^2$ would be preferred.

Tines 18 of combs 18*a*, 18*b* interdigitate between the cutters 14 and spacers 15 on the downstream side of the cutting area 12 to prevent web material leaving the hopper 11 other than through the gap available between the two rows 13*a*, 13*b* and to clear torn pieces from the cutting teeth.

The disc cutters 14 have an overall diameter of 260 mm and the spacers a diameter of some 160 mm. Each shaft 16*a*, 16*b* is driven at a speed of some 140 rpm. A processing rate of some 24 meters of web a minute is possible.

The length of the hopper 11 is desirably slightly in excess of the width of the web fed to it and in the case of webs of a width of 1 meter, a hopper length of some 1070 mm has proved to be suitable this providing some 17 disc cutters in each row (34 cutters in all).

A particularly suitable pulp shredding mill 10 is based on the Birkett Cutmaster AZ45 machine marketed in the United Kingdom by Carolo Engineering Group PLC.

Figure 3:
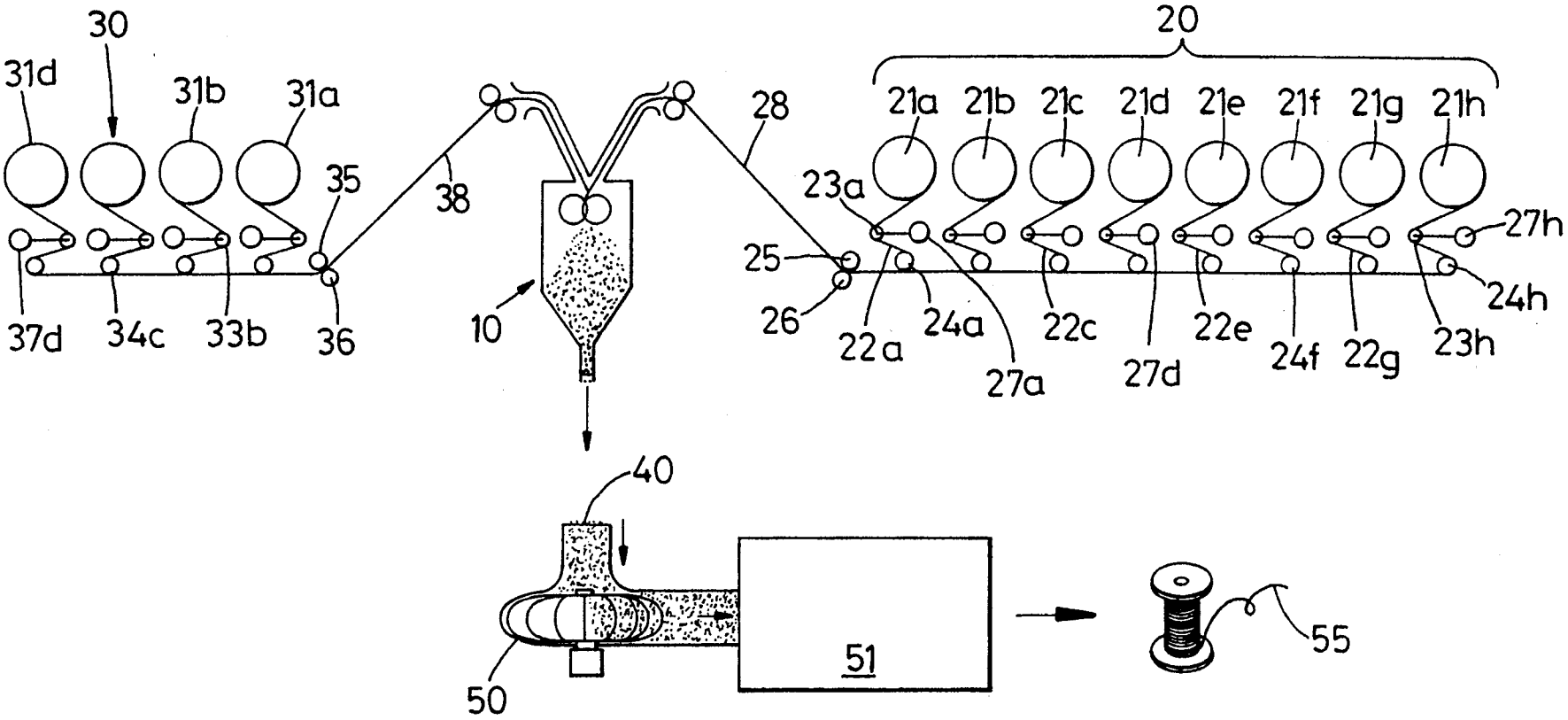
FIG. 3 is a schematic view of two roll stands designed to feed pluri-layer webs as input to the pulp shredder shown in FIGS. 1 and 2.

FIG. 3 shows part of a wood pulp processing plant showing an LV roll stand 20 and an HV roll stand 30, each roll stand feeding its respective output web to the pulp mill 10.

The LV roll stand 20 comprises eight stock rolls 21*a* . . . 21*h* each feeding sheet material 22*a* . . . 22*h* downwardly to a pair of idler rollers 23*a*, 24*a* . . . 23*h*, 24*h*.

The outlet end of the LV stand 20 is defined by a nip created between a roller pair 25, 26 which frictionally engages the web created from the eight layers of sheet materials 22*a* . . . 22*h*. Both rollers 25, 26 are suitably driven to create a desired web advance speed and create the driving traction for withdrawing sheet material from each of the stock rolls 21*a* . . . 21*h*.

To control the path of the sheet from a respective stock roll to the line of advance of the web, idler rollers 23*a* . . . 23*h* and 24*a* . . . 24*h* each bear against the respective sheet in contact with it over part only of its circumference, this degree of contact being sufficient to ensure that, under normal circumstances, there is negligible slippage between the advancing sheet material and at least the respective upper roller 23*a* . . . 23*h*. A motion sensing device (shown schematically at 27*a* . . . 27*h*) is connected to each of the rollers 23*a* . . . 23*h*, these sensing devices being used to determine when sheet material is not being advanced from the respective stock roll e.g. because a breakage has occurred or the stock roll in question has become exhausted of sheet material.

The HV roll stand 30 is similarly constructed to the LV roll stand and for convenience the reference numbers 31–37 have been used to correspond to the numbers 21–27 used in the description of the LV roll stand. It will be noted, however, that there are only four stock rolls on the HV stand so that "d" is the highest reference letter used in connection with the individual stock rolls in the HV stand. The nominal eight-layer web leaving the LV stand 20 has been given the reference number 28 and the nominal four-layer HV web leaving the stand 30 has been given the reference number 38. These pluri-layer webs 28 and 38 are fed together to the pulp shredder described earlier with reference to FIGS. 1 and 2 but schematically illustrated in FIG. 3 by the reference number 10.

Since the two roll stands are independent with their own nip pair 25:26 and 35:36, the relative speeds of advance of the two webs 28 and 38 can be independently selected to give a desired final feedstock composition in the comminuted material leaving the pulp shredder 10

Figure 4:
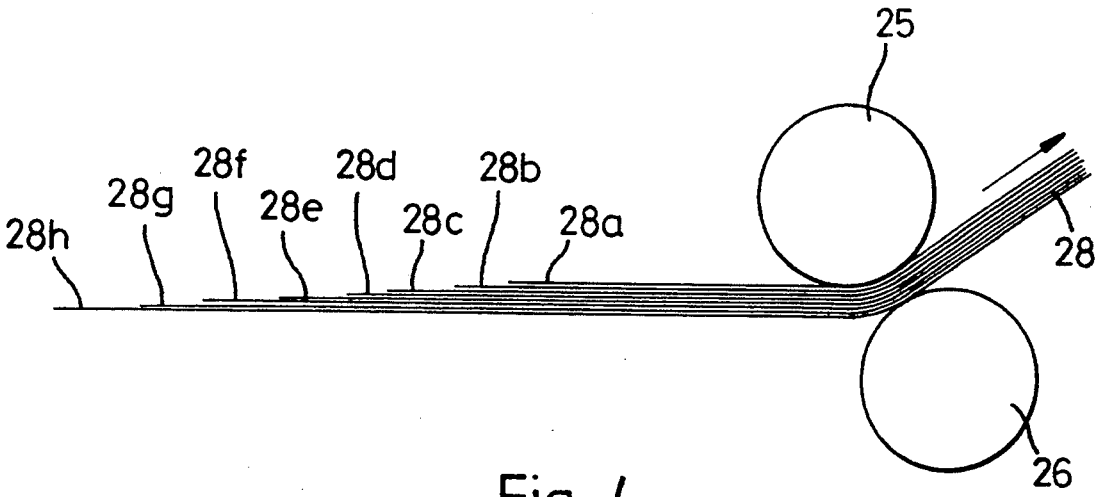
FIG. 4 is an enlarged view of the outlet end of one of the roll stands shown in FIG. 3 showing the pluri-layer web created as a precursor for the comminuted feedstock material.
Figure 5:
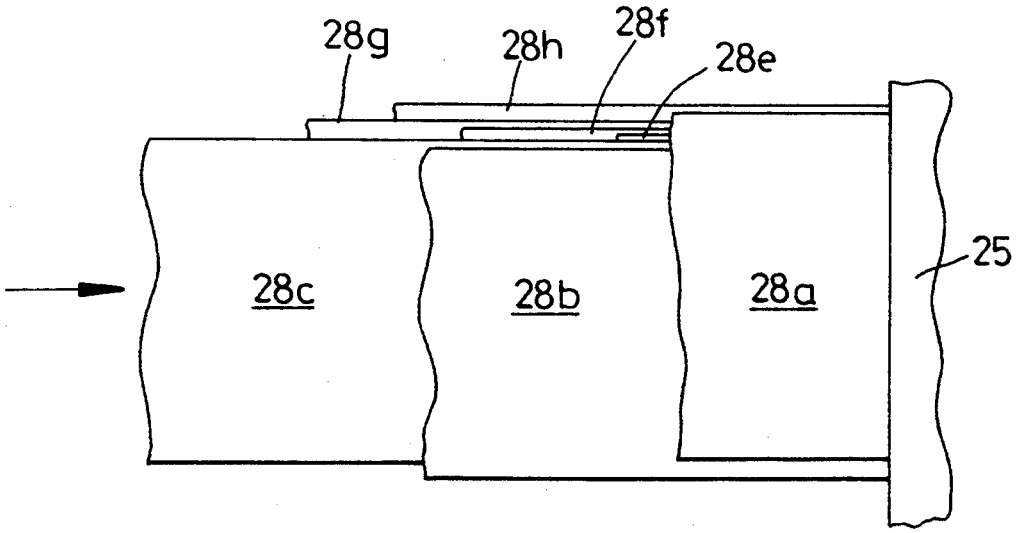
FIG. 5 is a schematic plan of a pluri-layer web leaving a roll stand.

FIG. 4 shows in side elevation and FIG. 5 shows in plan, the composite web 28 leaving the LV stand 20. Eight layers 22*a* to 22*h* are shown in FIG. 4 but only seven layers in FIG. 5, web layer 22*d* being missing due to exhaustion of material from the stock roll 21*d*.

Figure 6:
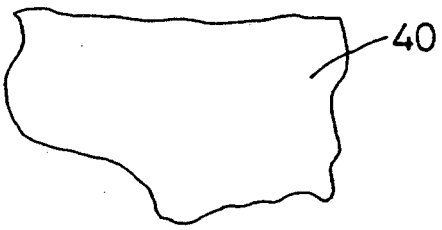
FIG. 6 is a plan of one piece torn from a web by the mill of FIGS. 1 and 2.

FIG. 6 shows a torn off piece 40 of one layer of one of the web 28, 38 fed to the pulp mill or shredder 10. This piece has an area of around 10 $mm^2$ and is characterised by being torn from the layer it formed in a manner which does not cause it to permanently adhere to pieces torn from adjacent layers and which ensures there is no (or no significant) compression of the edge regions defining the torn periphery of the piece 40. The absence of adherence between pieces is important in the case of the output of the mill 10 going on to a continuous process plant (although it is less important in a batch processing plant where local inhomogeneities within a batch are not usually significant). The absence of any significant edge compression of the piece 40 facilities subsequent processing where digestion of the piece in a liquid occurs.

Any temporary adherence between pieces 40 making up a laminated platelet torn from a pluri-layer web can be destroyed by agitating the platelets in the casing of a cutter fan 50 which is used to suck the torn platelets of pieces 40 away from the mill 10 and convey them pneumatically to some downstream processing unit 51 producing fibre 55.

The fan 50 can be of the sort used in a waste disposal role to recieve trimmed off edge strip from a paper- or film-making machine and to break up the strip into pieces for easier disposal. The cloud of torn platelets from the mill 10 can be led to the central region of the rotating rotor of a centrifugal fan 50 and in moving radially out to the tangentially disposed fan outlet is agitated by the blades of the rotor. The level of agitation can be controlled by the design of the rotor and its cooperating casing and by the speed of rotation. It is possible to provide a further size reduction of the separated pieces 40 in the cutter fan 50, but normally agitation at a level sufficient to break the torn platelets into individual layer pieces 40 is all that is required.

When the method of the invention is being used to create feedstock from a HV pluri-layer web 38 and a separate LV pluri-layer web 28, it is normal to have the HV web advancing into the hopper 11 at a slower rate than the LV web. This has the result of producing smaller pieces from the HV web than from the LV web and this mix of sizes can be convenient in the subsequent treatment of the feedstock produced.

The foregoing represents one embodiment of the invention and it should be appreciated that other arrangements are possible within the scope of the following claims.

What is claimed is:

1. A method of creating a comminuted feedstock of wood pulp for use in a processing plant which includes the steps of:

a) mounting a plurality of rolls of wood pulp sheet material of a first range of properties in a first roll stand, b) drawing sheet material off each roll in the first roll stand and laying the sheet materials one on the other to create a first pluri-layer web, c) withdrawing the first pluri-layer web from the first roll stand and leading it to a cutting area of a shredding mill, d) acting on the first pluri-layer web in the cutting area with rotating hooked disc cutters to tear platelets from the first pluri-layer web and to pass said torn platelets to an outlet of the shredding mill, e) pneumatically conveying the torn platelets away from the outlet using a fan with a bladed member rotating in a fan casing, and f) beating the torn platelets with the bladed member as they are conveyed through the fan casing to separate the torn platelets into pieces torn from the individual layers making up the first pluri-layer web.

2. A method according to claim 1, wherein a second roll stand is provided to create a second pluri-layer web and said first and second webs are fed together into the cutting area of the shredding mill.

3. A method according to claim 2, wherein the first pluri-layer web is made up of sheet materials having viscosity ratings in a first band of viscosities and the second pluri-layer web is made up of sheet materials having viscosity ratings in a second band of viscosities which is higher than said first band.

4. A method according to claim 3, wherein the rate of advance of the second web to the cutting area is lower than the rate of advance of the first web to the cutting area.

5. A method according to claim 1, wherein there are between four and twelve layers of sheet material in the first pluri-layer web.

6. A method according to claim 2, wherein there are $2p/3$ layers of sheet material in the first web and $p/3$ layers of sheet material in the second web, p being an integer number which is a multiple of 3 and which is not less than 6.

7. A method according to claim 6, wherein p is equal to 12.

8. A method of creating a comminuted feedstock of wood pulp for use in a processing plant which includes the steps of:

a) feeding wood pulp in sheet form to a cutting area created by a nip formed between contra-rotating interdigitating hooked disc cutters, tearing pieces from the sheet-formed pulp with the hooks and passing the torn pieces through the nip, b) receiving the torn pieces downstream of the nip in the casing of a fan having a bladed rotor turnably mounted in the casing, c) drawing the torn pieces through the casing by pneumatic flows created by the bladed rotor, and d) breaking up the torn pieces in the casing by engagement with the bladed rotor.

9. A method according to claim 8, wherein the pieces of wood pulp have an area of between 2 and 20 $cm^2$.

10. In the production of cellulosic fiber from wood pulp sheeting the improvement which comprises forming a pluri-layer web from the sheeting, tearing laminated platelets from the web and separating the platelets into sheeting pieces in a cutter fan used to convey the sheeting pieces in the process.

11. The process claimed in claim 10 wherein tearing is effected between contra-rotating toothed disk cutters.

* * * * *

UNITED STATES PATENT AND TRADEMARK OFFICE

CERTIFICATE OF CORRECTION

PATENT NO. : 5,375,780
DATED : December 27, 1994
INVENTOR(S) : Gary G.E. Gray, et. al.

It is certified that error appears in the above-indentified patent and that said Letters Patent is hereby corrected as shown below:

Col. 5, line 68, cancel "10 $mm^2$" and substitute --10 $cm^2$--.

Signed and Sealed this

Thirtieth Day of May, 1995

*Attest:*

BRUCE LEHMAN

*Attesting Officer*

*Commissioner of Patents and Trademarks*